US005804130A

United States Patent [19]

Furlani et al.

[11] Patent Number: 5,804,130

[45] Date of Patent: Sep. 8, 1998

[54] EMBEDDING A MULTIWOUND MICROCOIL IN A CERAMIC STRUCTURE

[75] Inventors: Edward P. Furlani, Lancaster; Syamal K. Ghosh; Dilip K. Chatterjee, both of Rochester, all of N.Y.

[73] Assignee: Eastman Kodak Company, Rochester, N.Y.

[21] Appl. No.: 896,901

[22] Filed: Jul. 18, 1997

[51] Int. Cl.[6] ..... B28B 1/38

[52] U.S. Cl. ..... 264/610; 264/619; 427/105; 427/116

[58] Field of Search ..... 264/610, 614, 264/619, 620, 621; 427/58, 104, 105, 116

[56] References Cited

U.S. PATENT DOCUMENTS

| | | | |
|---|---|---|---|
| 2,744,839 | 5/1956 | Radley | 117/218 |
| 5,066,432 | 11/1991 | Gabathuler et al. | 264/28 |
| 5,423,521 | 6/1995 | Stover et al. | 266/220 |

*Primary Examiner*—Christopher A. Fiorilla

*Attorney, Agent, or Firm*—Raymond L. Owens

[57] ABSTRACT

A method for forming an embedded multiwound microcoil in a ceramic substrate including the steps of forming a sacrificial mutiwound microcoil to be used in the ceramic substrate by wrapping a first sacrificial coil winding about the midsection of a sintered ceramic bar thereby forming a one winding sacrificial coil structure; dipping the one winding sacrificial coil structure in a sol-gel precursor and then forming an encapsulated one winding sacrificial coil structure from such sol-gel precursor; wrapping a second sacrificial coil winding about the midsection of the encapsulated one winding sacrificial coil structure thereby forming a two winding sacrificial coil structure. The method further includes incorporating the multiwound sacrificial coil structure into a green ceramic substrate; sintering the green ceramic substrate at a sufficient temperature to burn away the sacrificial coil windings thereby forming an embedded coil receiving cavity; flowing molten electrically conductive material into the embedded coil receiving cavity; and cooling the molten electrically conductive material to form the multiwound microcoil embedded in a ceramic substrate.

4 Claims, 8 Drawing Sheets

EMBEDDING A MULTIWOUND MICROCOIL IN A CERAMIC STRUCTURE

CROSS REFERENCE TO RELATED APPLICATION

Reference is made to commonly assigned U.S. patent application Ser. No. 08/751,529, filed Nov. 14, 1996, now U.S. Pat. No. 5,683,649 entitled "A Method For The Fabrication Of Micro-Electromechanical Ceramic Parts With an Electrical Trace" by Chatterjee et al, the teachings of which is incorporated herein.

FIELD OF THE INVENTION

This invention relates generally to the field of micro-electromechanical devices, and in particular to a method for fabricating multiwound microcoils embedded in a ceramic substrate using organic sacrificial fibers.

BACKGROUND OF THE INVENTION

Conventional electromechanical devices are greater than 1 cubic centimeter in volume. The materials and methods for the fabrication of these devices are inadequate for the fabrication of micro-electromechanical devices which are less than 1 cubic centimeter in volume. However, such microdevices can be fabricated using micromolded ceramic technology. One drawback to this approach is that electromechanical devices such as motors and actuators typically utilize energized coils to implement the motion of a permanent magnet or vice versa. For microdevices, these coils need to be on the order of 100 microns in diameter or less, and they need to be attached to, or embedded in, the micromolded sintered ceramic piece. However, highly conductive materials such as copper or gold have a melting point below the sintering temperature, and therefore cannot be embedded before sintering.

SUMMARY OF THE INVENTION

It is an object of the present invention to provide an effective method for fabricating a multiwound microcoil embedded in a ceramic substrate.

This object is achieved in a method for forming an embedded multiwound microcoil in a ceramic substrate comprising the steps of:

a) forming a sacrificial mutiwound microcoil to be used in the ceramic substrate by;
   (i) wrapping a first sacrificial coil winding about the midsection of a sintered ceramic bar thereby forming a one winding sacrificial coil structure;
   (ii) dipping the one winding sacrificial coil structure in a sol-gel precursor and then forming an encapsulated one winding sacrificial coil structure from such sol-gel precursor;
   (iii) wrapping a second sacrificial coil winding about the midsection of said encapsulated one winding sacrificial coil structure thereby forming a two winding sacrificial coil structure;
   (iv) repeating steps (a)(ii) and (a)(iii) until the desired number of sacrificial coil windings are formed;

b) incorporating the multiwound sacrificial coil structure into a green ceramic substrate;

c) sintering the green ceramic substrate at a sufficient temperature to bum away the sacrificial coil windings thereby forming an embedded coil receiving cavity;

e) flowing molten electrically conductive material into the embedded coil receiving cavity; and f) cooling the molten electrically conductive material to form the multiwound microcoil embedded in a ceramic substrate.

The present invention has the following advantages:

1. Micro-electromechanical devices formed in ceramic substrates having embedded multiwound coils can be readily fabricated using the method of the present invention.
2. A large number of micromolded devices can be fabricated at one time; and because the devices are fabricated in a ceramic substrate they are able to withstand harsh high temperature and corrosive operating environments.
3. It is especially advantageous to use organic sacrificial fibers which will melt during sintering and which are clean burning and leave little or no residual material, since carbon and hydrogen atoms in the organic sacrificial fibers will become gaseous during the high temperature sintering step.

These and other aspects, objects, features, and advantages of the present invention will be more clearly understood and appreciated from a review of the following detailed description of the preferred embodiment and appended claims, and by reference to the accompanying drawings.

DETAILED DESCRIPTION OF THE PREFERRED EMBODIMENTS

The method of the present invention will be described in conjunction with the fabrication of a specific component. This is by way of example only in that the teachings of the present method can be used to fabricate a wide range of micro-electromechanical components or devices.

Figure 1:
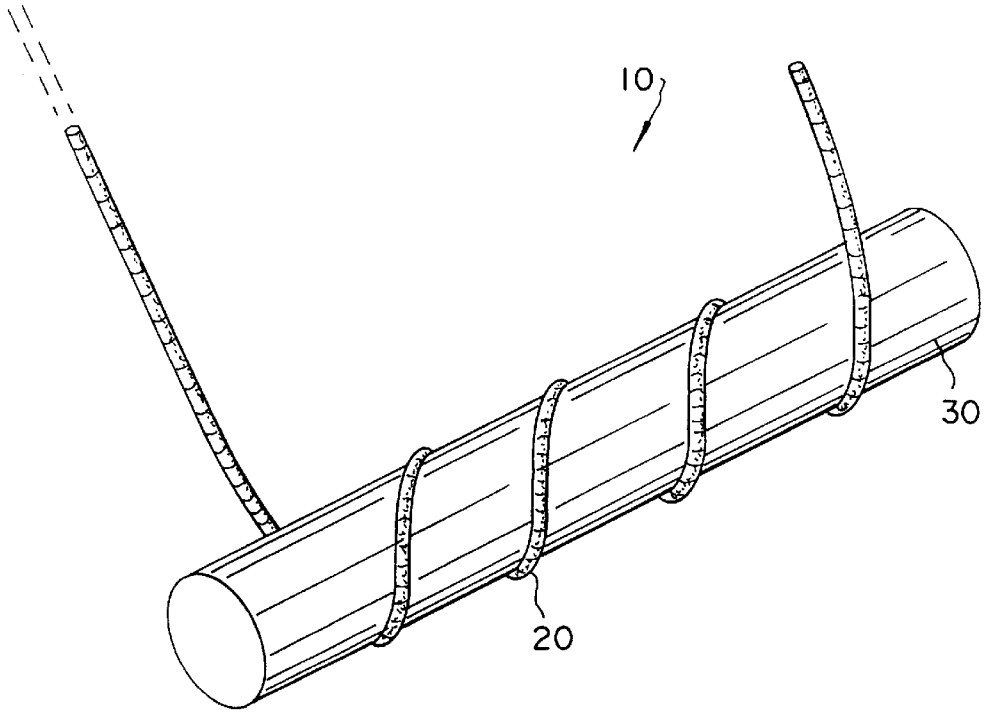
FIG. 1 is a perspective of a one winding sacrificial coil structure including a ceramic bar with a first sacrificial coil winding wrapped about its midsection.

Referring to FIG. 1, a perspective is shown of a one winding sacrificial coil structure 10 including a first sacrificial coil winding 20 wrapped in a helical fashion on the midsection of sintered cylindrical ceramic bar 30. The first sacrificial coil winding 20 is made from organic materials such as polyvinyl alcohol, polyethylene glycol or acrylic or plastic and is on the order of 100 microns in diameter or less. These organic materials should be clean burning in that they become a gaseous product at sintering temperatures and leave little or no residual material.

Figure 2A:
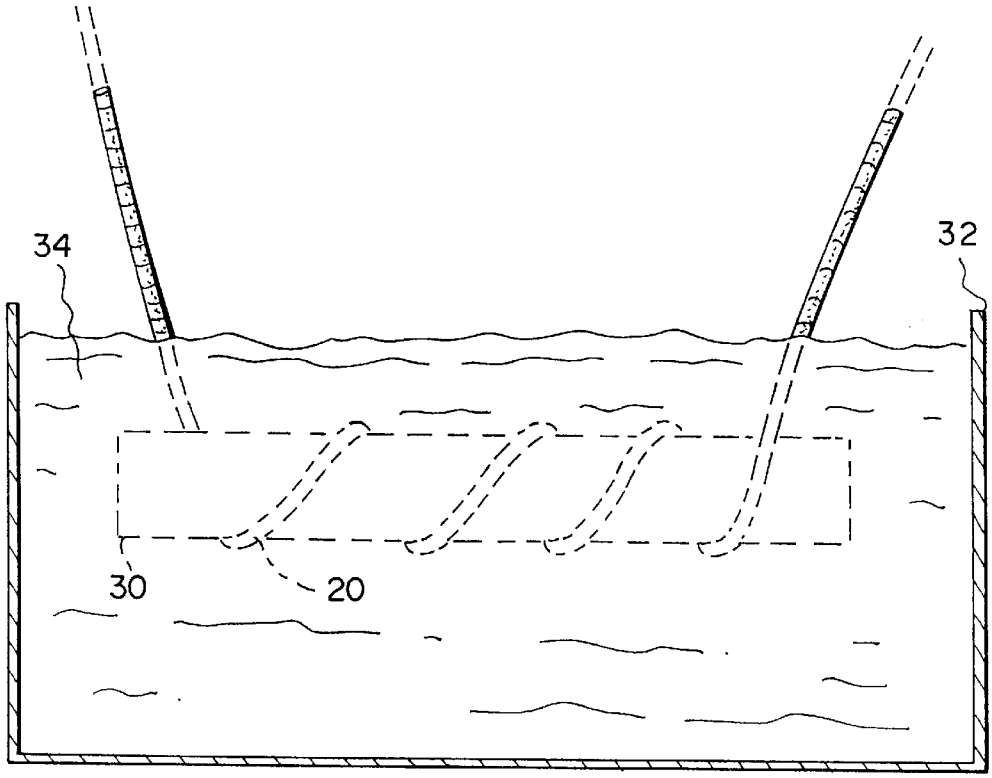
FIGS. 2A and 2B are views which show a first layer coating process in which the one winding sacrificial coil structure is dipped in a sol-gel precursor, and then dried, respectively.

Referring to FIG. 2A a first layer coating process is shown in which the one winding sacrificial coil structure 10 of FIG. 1 is dipped in a container 32 containing a sol-gel precursor 34 selected from the group consisting of silicon dioxide, alumina, and alumina silicate. After an appropriate amount of time the one winding sacrificial coil structure 10 is removed from the sol-gel precursor 34 and is dried by heating it in an oven at approximately 100° C. This process produces an encapsulated one winding sacrificial coil structure 36 with a first layer of ceramic material 40 as shown in FIG. 2B.

Figure 3:
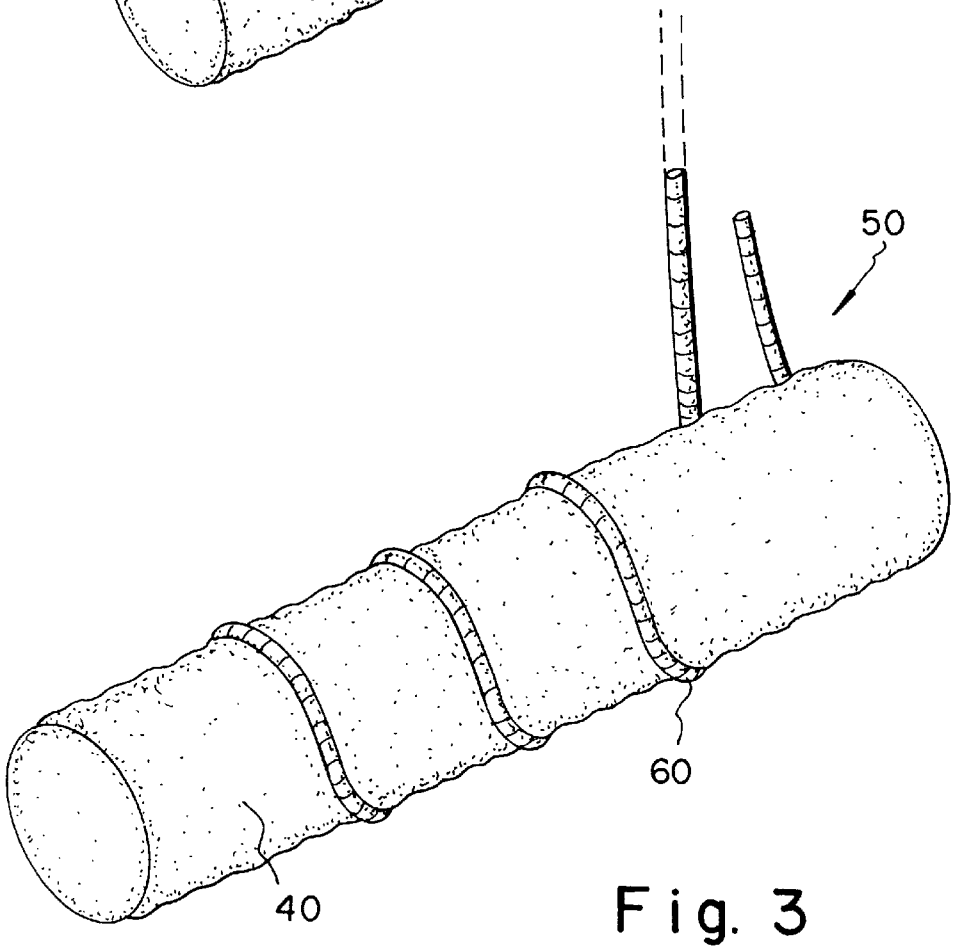
FIG. 3 is a perspective of a two winding sacrificial coil structure in which a second sacrificial coil winding is wrapped about the midsection of the first layer of cast ceramic material of FIG. 2B.

Referring to FIG. 3, a perspective is shown of a two winding sacrificial coil structure 50 including a second sacrificial coil winding 60 wrapped around the midsection of the first layer of ceramic material 40. The second sacrificial coil winding 60 is made from organic materials such as polyvinyl alcohol, polyethylene glycol or acrylic or plastics or carbon fiber and is on the order of 100 microns in diameter or less.

Figure 2B:
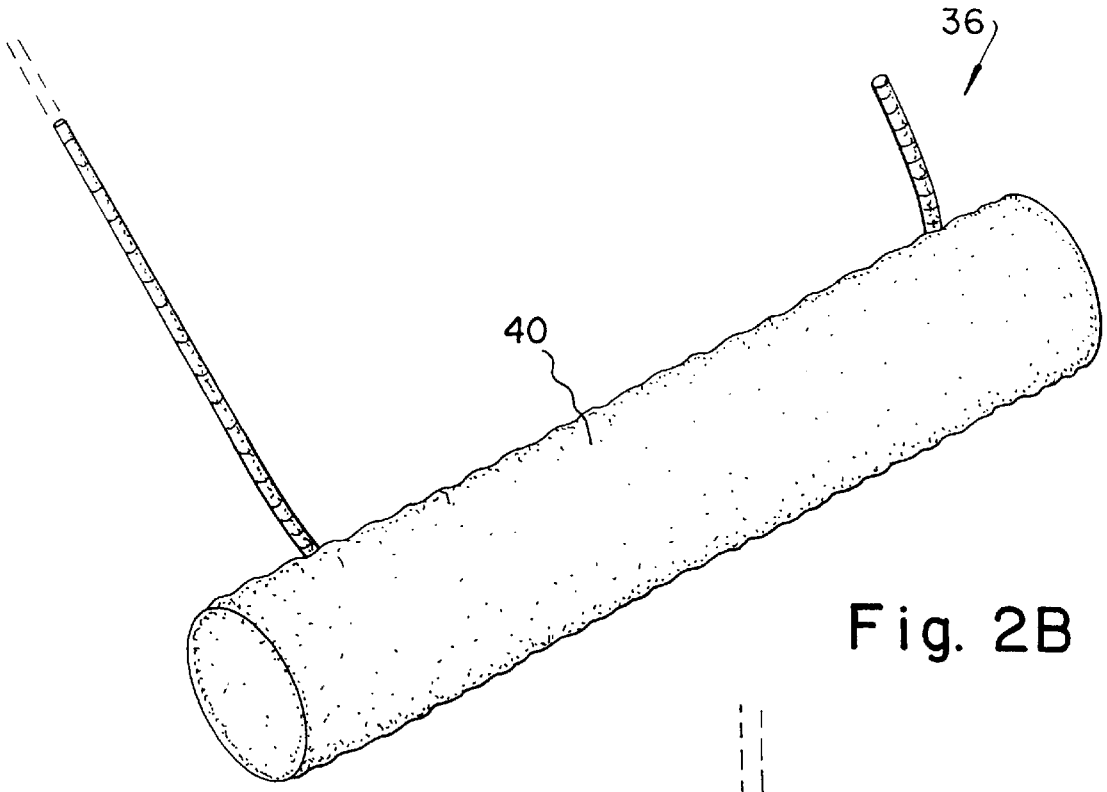
Figure 4:
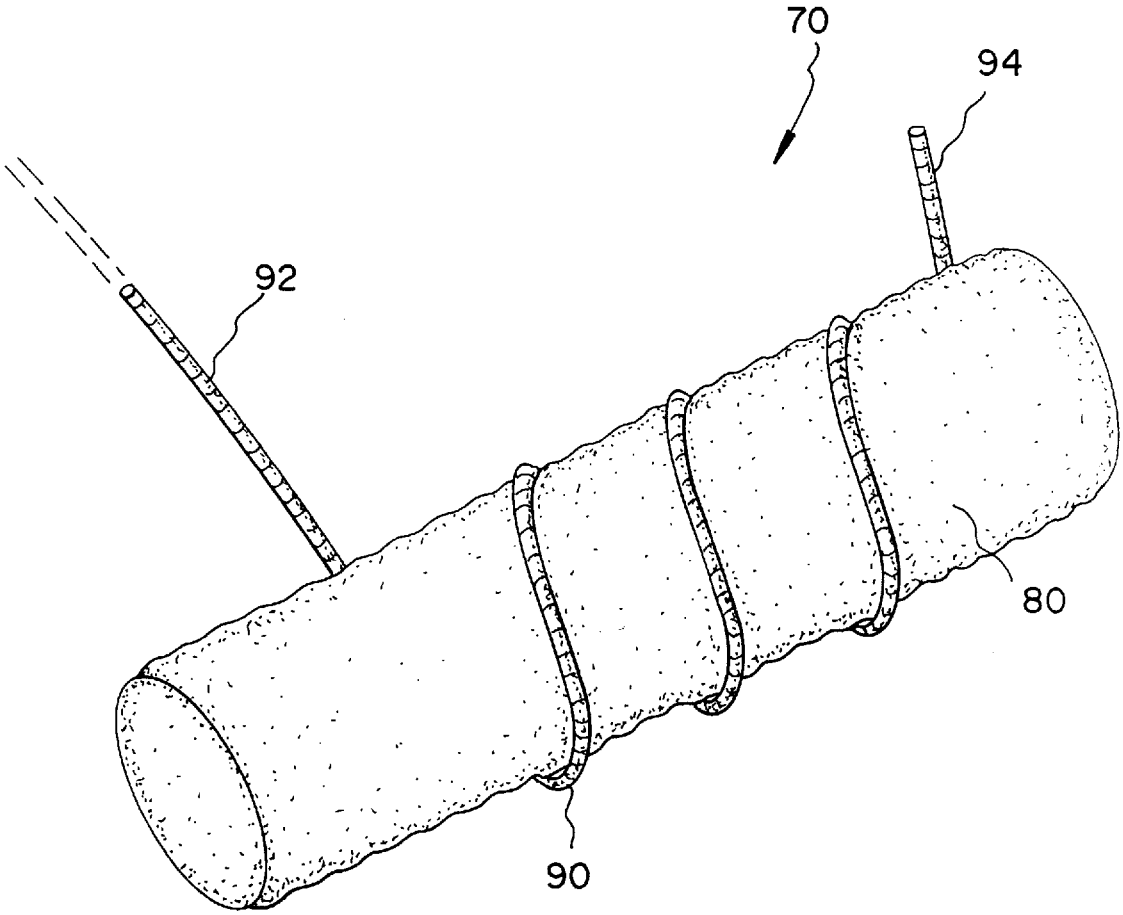
FIG. 4 is a perspective of the a three winding sacrificial coil structure in accordance with the present invention in which the two winding sacrificial coil structure of FIG. 3 is encapsulated in a second layer of ceramic material, and a third sacrificial coil winding is wrapped about the midsection of the second layer of ceramic material.

Referring to FIG. 4, a perspective is shown of a three winding sacrificial coil structure 70 which is fabricated by encapsulating the two winding sacrificial coil structure 50 in a second layer of ceramic material 80 using the coating process described in FIGS. 2A and 2B, and then winding a third sacrificial coil winding 90 around the midsection of the second layer of ceramic material 80. The third sacrificial coil winding 90 is made from organic materials such as polyvinyl alcohol, polyethylene glycol or acrylic or plastic or carbon fiber and is on the order of 100 microns in diameter or less. The three winding sacrificial coil structure 70 has terminal ends 92 and 94.

Figure 5A:
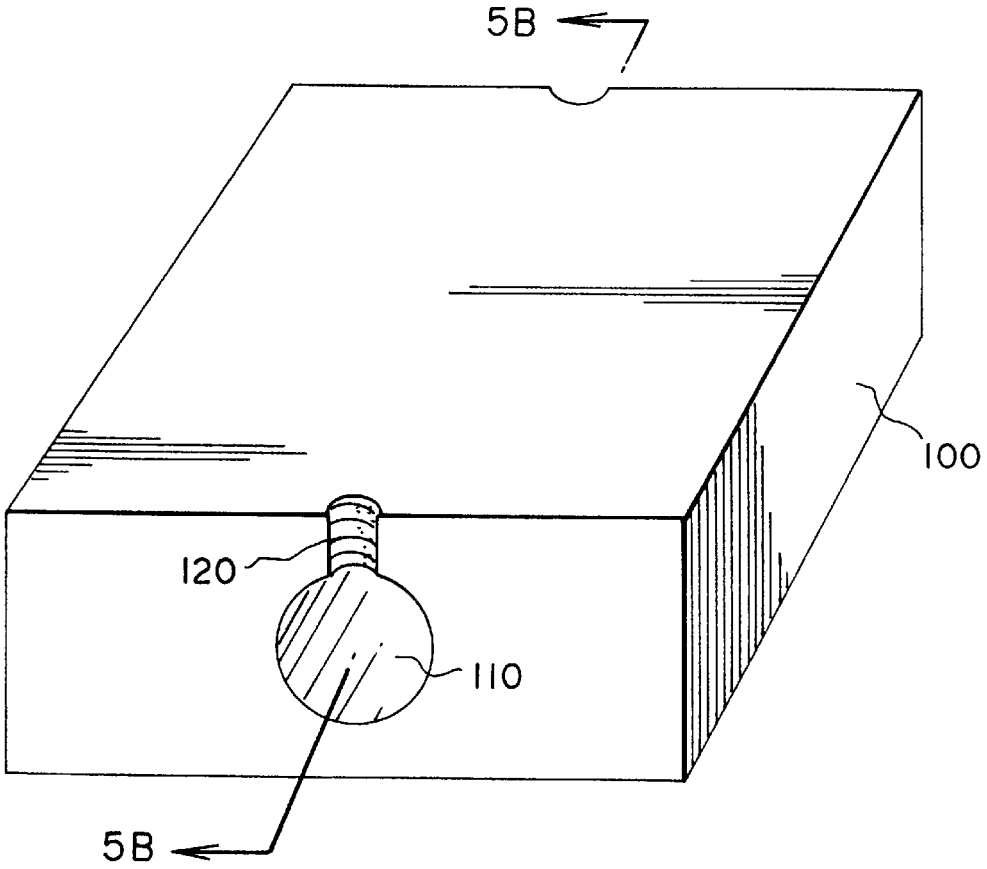
FIG. 5A illustrates in perspective, a micromolded ceramic substrate in accordance with the present invention.
Figure 5B:
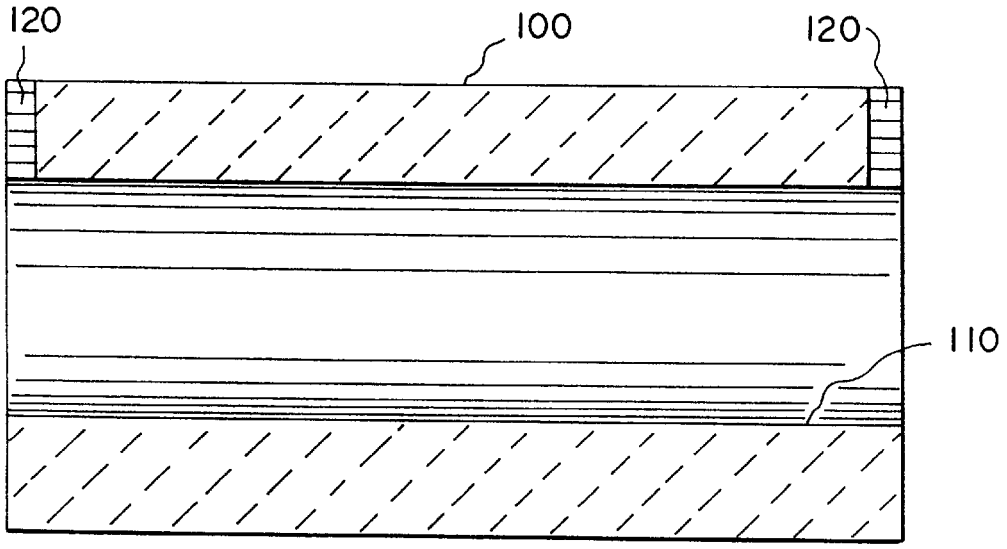
FIG. 5B is a cross sectional view of the micromolded ceramic substrate taken along the section lines B—B of FIG. 5A.

FIGS. 5A and 5B illustrate in perspective and cross-sectional view respectively, a rectangular micromolded ceramic substrate 100, to be selected from highly electrically insulating ceramics such as $Al_2O_3$, $ZrO_2$, AlN, BN, MgO, $Al_2O_3$—$ZrO_2$ composites, etc., in a green state, formed with a cylindrical cavity 110 and grooved paths 120 leading from the ends of the cavity 110 to the surface of the substrate. The fabrication of the micromolded ceramic substrate 100 preferably takes place in a mold which duplicates its outer shape and internal features. The use of the term "green" means that when particulate ceramic powder, preferably mixed with an organic binder is subjected to uniform compacting forces in order to provide an unsintered preform which has uniform density.

Figure 6A:
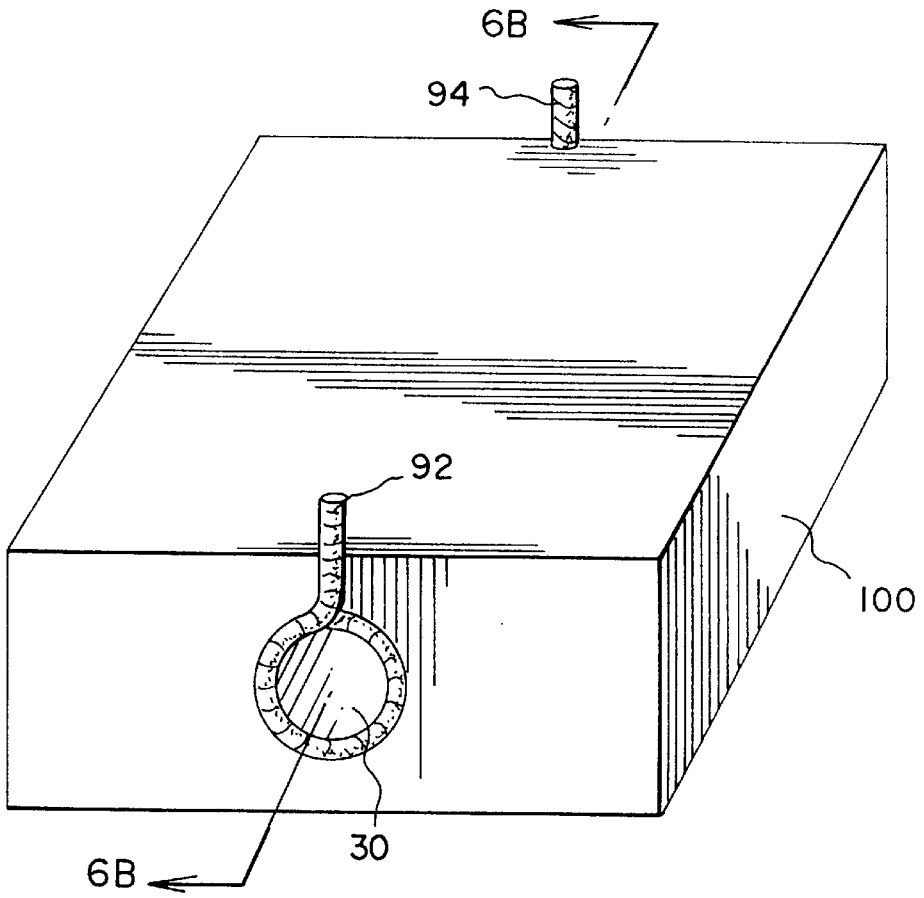
FIG. 6A illustrates a perspective of an assembled ceramic structure in which the sacrificial coil structure of FIG. 4 has been inserted into the micromolded piece of FIG. 5A.
Figure 6B:
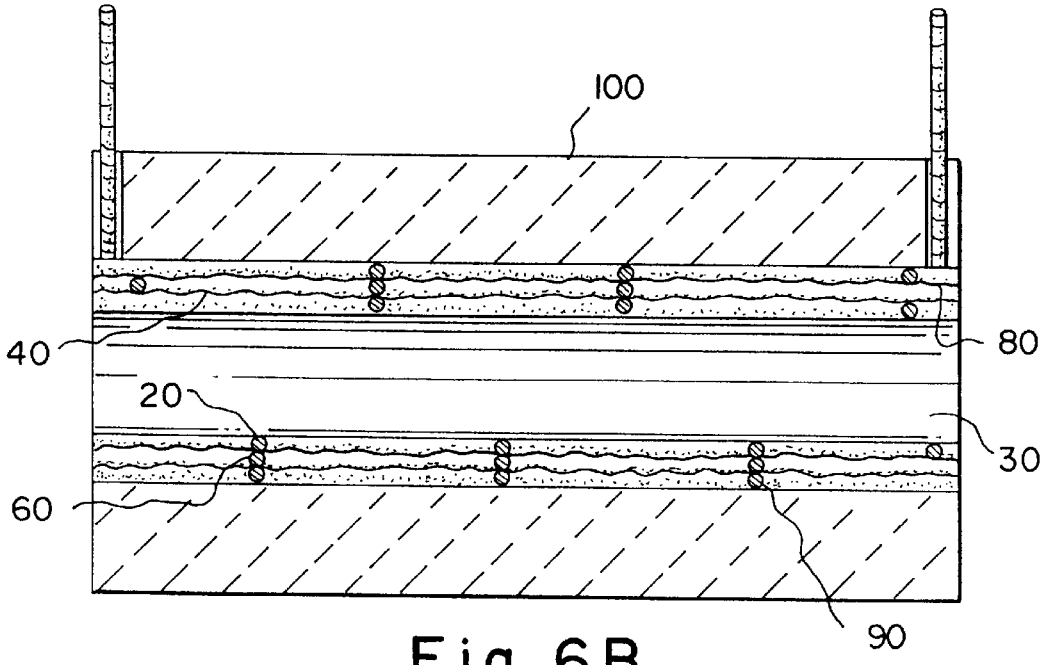
FIG. 6B is a cross sectional view of the assembled ceramic structure taken along the section line B—B of FIG. 6A.

Referring next to FIGS. 6A and 6B, in the next step of the process, the three winding sacrificial coil structure 70 is inserted into the cylindrical cavity 110 of micromolded ceramic substrate 100. The terminal ends 92 and 94 of the three winding sacrificial coil structure 70 are placed in grooved paths 120. It is instructive to note that the diameter of the cylindrical cavity 110 is large enough to accommodate the inserted three winding sacrificial coil structure 70 with additional space to allow for 20 to 30% shrinkage of the cavity 110 upon sintering so as to preclude fracturing of the micromolded ceramic substrate 100 during the sintering process.

Figure 7A:
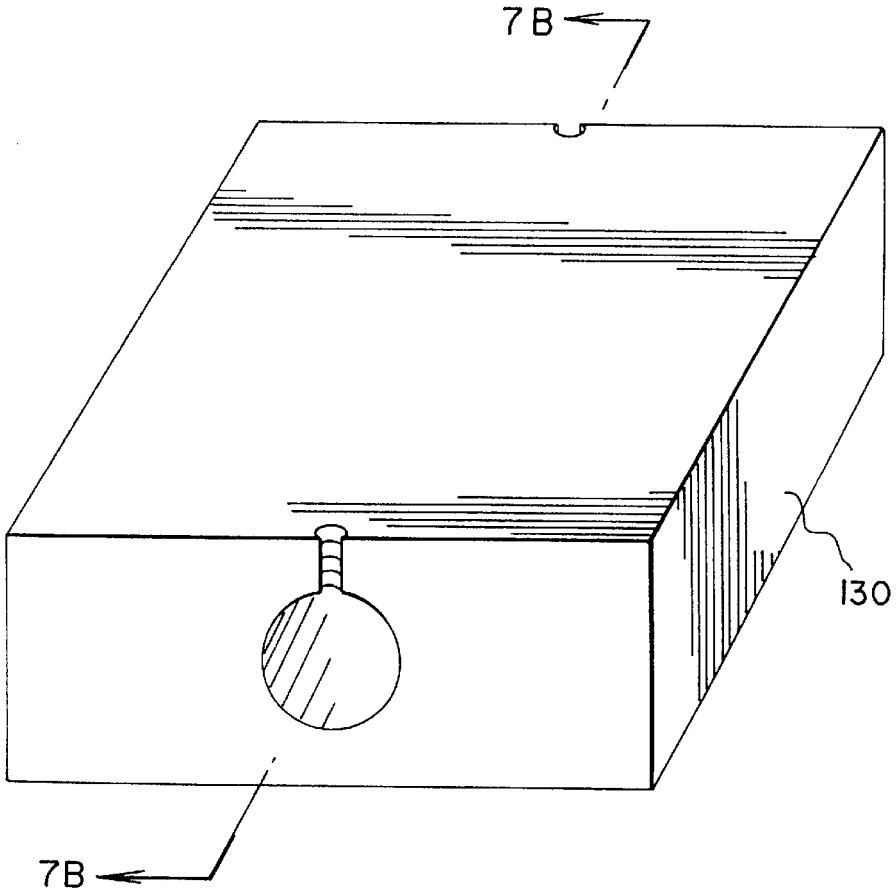
FIG. 7A illustrates a perspective of a unitary ceramic structure formed by sintering the assembled ceramic structure of FIG. 6A, which burns away the sacrificial coil windings leaving an embedded coil receiving cavity.
Figure 7B:
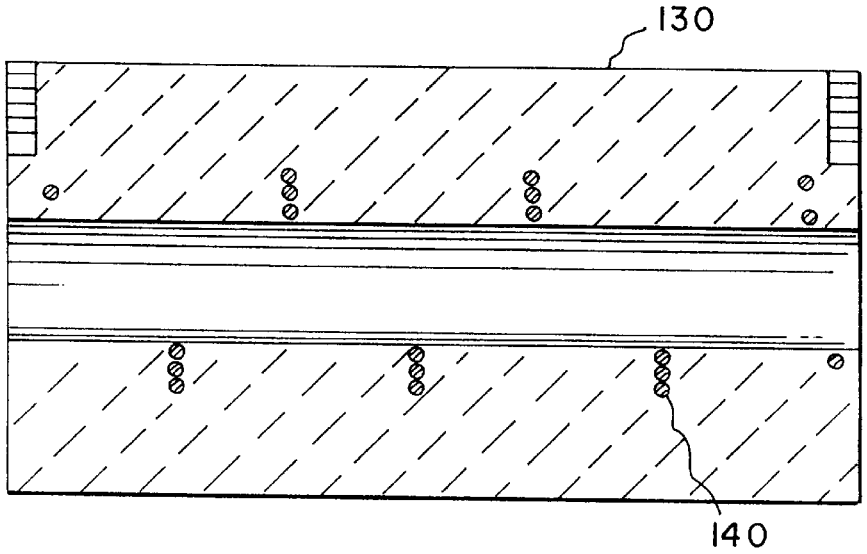
FIG. 7B is a cross sectional view taken along the section lines B—B of FIG. 7A.

Referring now to FIGS. 7A and 7B, in the next step of the process, the assembled structure of FIGS. 6A and 6B is sintered forming a unitary ceramic structure 130 in which the first, second and third sacrificial coil windings 20, 60 and 90 respectively, are burned away leaving an embedded coil receiving cavity 140 through the unitary ceramic structure 130.

Figure 8:
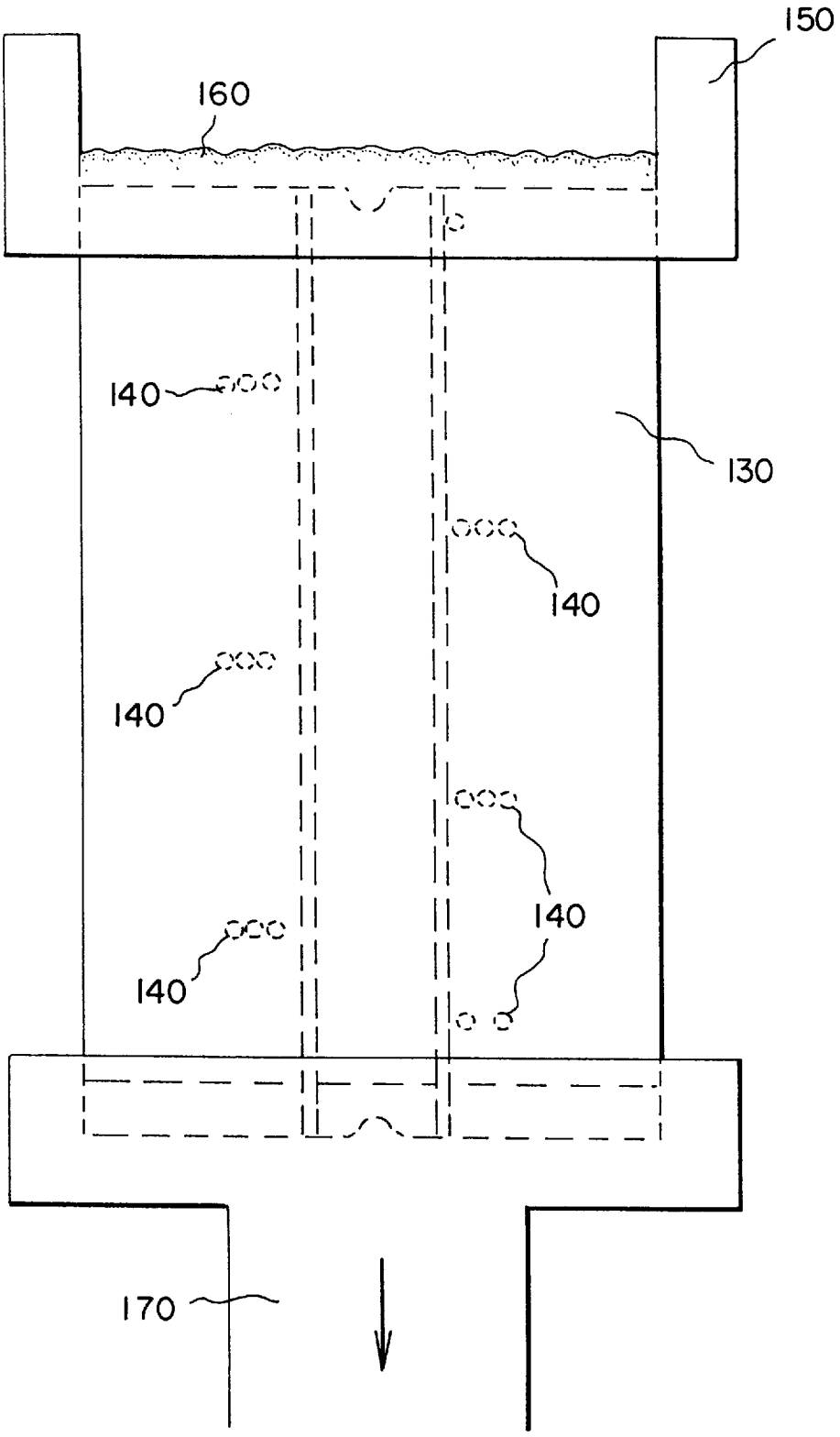
FIG. 8 illustrates the process of drawing a molten electrically conductive material into the embedded coil receiving cavity.

Referring now to FIG. 8, the unitary ceramic structure 130 with the embedded coil receiving cavity 140 is mounted in a vertical fashion with its top portion surrounded on all sides by a nonporous container 150 and a molten pool of electrically conductive metal or alloy 160 such as Au, Ag, Ag—Cu, or Cu—Sn, or alternatively, a thin layer of conductive paste which is applied over the top of the unitary ceramic structure 130. The bottom of the unitary ceramic structure 130 is connected to a vacuum chamber 170 which is continually pumped so as to draw the molten metal or alloy 160 or conductive paste through the embedded coil receiving cavity 140. In this way, the molten electrically conductive metal or alloy 160 is made to fill the embedded coil receiving cavity 140 thereby forming a multiwound microcoil 180 (see FIGS. 9A and 9B) embedded in the unitary ceramic structure 130.

Figure 9A:
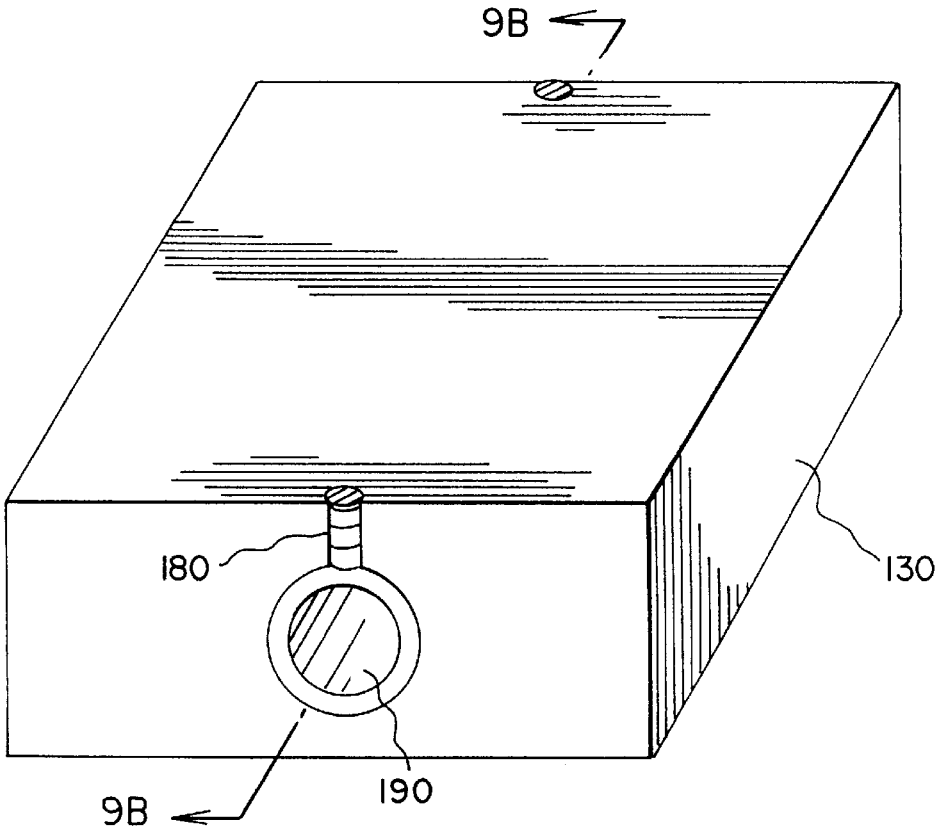
FIG. 9A illustrates a perspective view of the ceramic substrate of the present invention with the molten electrically conductive material hardened and in place.
Figure 9B:
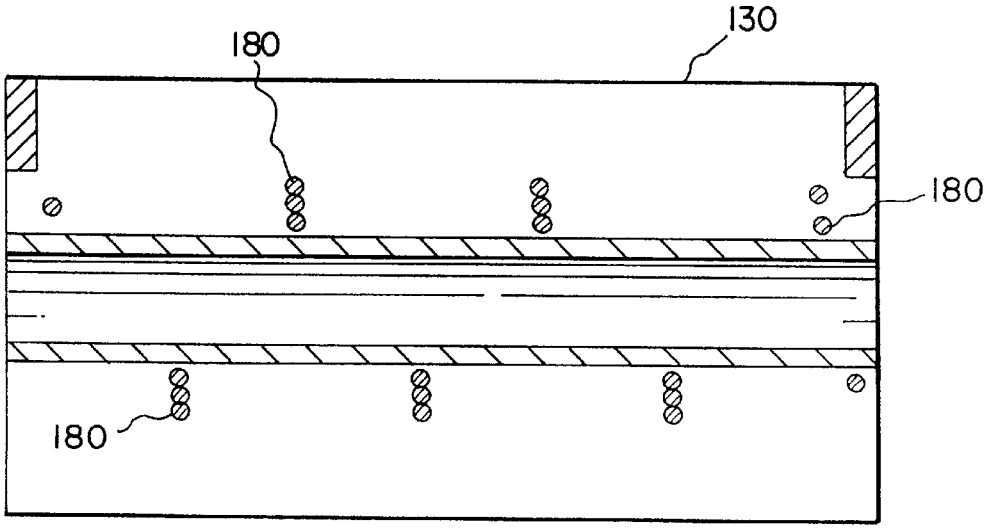
FIG. 9B is a cross sectional view taken along the section lines B—B of FIG. 9A.

Referring now to FIGS. 9A and 9B, the unitary ceramic structure 130 with the embedded multiwound microcoil 180 is subjected to a drilling operation to remove the sintered ceramic bar 30 so as to form a cylindrical cavity 190 that is concentric to the embedded multiwound microcoil 180. Alternatively, the sintered ceramic bar 30 can be chemically etched away preferentially with respect to the unitary ceramic structure 130. For example, the unitary ceramic structure 130 can be made using alumina or zirconia ceramic and the sintered ceramic bar 30 can be made using AIN or BN. This finished structure can be used in micro-electromechanical devices.

The invention has been described with reference to a preferred embodiment However, it will be appreciated that variations and modifications can be effected by a person of ordinary skill in the art without departing from the scope of the invention.

PARTS LIST

10 one winding sacrificial coil structure
20 first sacrificial coil winding
30 sintered ceramic bar
32 container
34 sol gel precursor
36 encapsulated one winding sacrificial coil structure
40 first layer of ceramic material
50 two winding sacrificial coil structure
60 second sacrificial coil winding
70 three winding sacrificial coil structure
80 second layer of ceramic material
90 third sacrificial coil winding
92 terminal end
94 terminal end
100 micromolded ceramic substrate

110 cylindrical cavity
120 grooved paths
130 unitary ceramic structure
140 embedded coil receiving cavity
150 nonporous container
160 molten pool of electrically conductive metal alloy
170 vacuum chamber
180 embedded multiwound microcoil
190 cylindrical cavity

What is claimed is:

1. A method for forming an embedded multiwound microcoil in a ceramic substrate comprising the steps of:

a) forming a sacrificial multiwound microcoil to be used in the ceramic substrate by;

(i) wrapping a first sacrificial coil winding about the midsection of a sintered ceramic bar thereby forming a first winding sacrificial coil structure;

(ii) dipping the first winding sacrificial coil structure in a sol-gel precursor and then drying the sol-gel precursor;

(iii) wrapping a second sacrificial coil winding about the midsection of said first winding sacrificial coil structure thereby forming a second winding sacrificial coil structure;

(iv) repeating steps (a)(ii) and (a)(iii) until the desired number of sacrificial coil windings are formed;

b) inserting the multiwound sacrificial coil structure into a green ceramic substrate cavity sized to accommodate for 20–30% shrinkage of the green ceramic substrate upon sintering to provide an assembled structure;

c) sintering the assembled structure at a sufficient temperature to bum away the sacrificial coil windings thereby forming a unitary ceramic structure having embedded coil receiving cavities;

e) flowing molten electrically conductive material into the embedded coil receiving cavity; and f) cooling the molten electrically conductive material to form the multiwound microcoil embedded in a ceramic substrate.

2. The method of claim 1, wherein the sacrificial multiwound coil is made from clean-burning organic materials which are selected from the group consisting of polyvinyl alcohol, polyethylene glycol and acrylic and are selected to melt during sintering.

3. The method of claim 1, wherein the sol-gel precursor is selected from the group of ceramic materials consisting of silicon dioxide, alumina, and alumina silicate.

4. A method for forming an embedded multiwound microcoil in a ceramic substrate comprising the steps of:

a) forming a sacrificial multiwound microcoil to be used in the ceramic substrate by;

(i) wrapping a first sacrificial coil winding about the midsection of a sintered ceramic bar thereby forming a first winding sacrificial coil structure;

(ii) dipping the first winding sacrificial coil structure in a sol-gel precursor and then drying the sol-gel precursor;

(iii) wrapping a second sacrificial coil winding about the midsection of said first winding sacrificial coil structure thereby forming a second winding sacrificial coil structure;

(iv) repeating steps (a)(ii) and (a)(iii) until the desired number of sacrificial coil windings are formed;

b) inserting the multiwound sacrificial coil structure into a green ceramic substrate cavity sized to accommodate for 20–30% shrinkage of the green ceramic substrate upon sintering to provide an assembled structure;

c) sintering the assembled structure at a sufficient temperature to burn away the sacrificial coil windings thereby forming a unitary ceramic structure having embedded coil receiving cavities;

e) flowing molten electrically conductive material into the embedded coil receiving cavity;

f) cooling the molten electrically conductive material to form the multiwound microcoil embedded in a ceramic substrate; and (g) removing the sintered ceramic bar.

* * * * *